US009296218B2

(12) United States Patent
Kondo et al.

(10) Patent No.: US 9,296,218 B2
(45) Date of Patent: Mar. 29, 2016

(54) PRINTING APPARATUS

(71) Applicant: SEIKO EPSON CORPORATION, Tokyo (JP)

(72) Inventors: Takamitsu Kondo, Azumino (JP); Toru Takahashi, Azumino (JP); Hiroshi Wada, Azumino (JP); Kazuyoshi Tanase, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/223,092

(22) Filed: Mar. 24, 2014

(65) Prior Publication Data

US 2014/0292928 A1 Oct. 2, 2014

(30) Foreign Application Priority Data

Mar. 29, 2013 (JP) ..... 2013-071618

(51) Int. Cl.

| | |
|---|---|
| ***B41J 2/21*** | (2006.01) |
| ***B41J 11/00*** | (2006.01) |
| *B41J 2/155* | (2006.01) |
| *B41J 25/00* | (2006.01) |

(52) U.S. Cl.

CPC ..... *B41J 2/2107* (2013.01); *B41J 2/2103* (2013.01); *B41J 11/002* (2013.01); *B41J 2/155* (2013.01); *B41J 2025/008* (2013.01)

(58) Field of Classification Search

None

See application file for complete search history.

(56) References Cited

U.S. PATENT DOCUMENTS

2004/0179080 A1 9/2004 Hasebe et al.
2008/0238998 A1 * 10/2008 Nakazawa et al. ..... 347/42

FOREIGN PATENT DOCUMENTS

JP 2004-268549 9/2004
JP 2007-276248 10/2007

* cited by examiner

*Primary Examiner* — Justin Seo
(74) *Attorney, Agent, or Firm* — Workman Nydegger

(57) ABSTRACT

A printing apparatus includes: a supporting member which supports a medium; a transport device which transports the medium; first to fourth heads which eject first to fourth radiation curable type inks; a first irradiation section; a second irradiation section; a third irradiation section; and a fourth irradiation section which is arranged on the downstream side of the fourth head, in which the radiation rays respectively irradiated from the first irradiation section to the third irradiation section have a peak wavelength of 350 nm to 450 nm, and coloring materials included in the third ink and the fourth ink have higher absorption properties of the radiation rays with the peak wavelength than coloring materials included in the first ink and the second ink.

8 Claims, 9 Drawing Sheets

FIG. 5

| ABBREVIATION | NAME | C | M | Y | K | APPLICATION | REMARKS |
|---|---|---|---|---|---|---|---|
| VEEA | (ACRYLIC ACID 2-(2-VINYLOXYETHOXY) ETHYL, PRODUCT NAME, MANUFACTURED BY NIPPON SHOKUBAI CO., LTD.) | 20.0 | 20.0 | 20.0 | 20.0 | POLYMERIZABLE COMPOUND (VINYL ETHER GROUP-CONTAINING (METH)ACRYLATE ESTER TYPE) | BIFUNCTIONAL MONOMER |
| PEA | VISCOAT #192 (PHENOXYETHYL ACRYLATE, PRODUCT NAME, MANUFACTURED BY OSAKA ORGANIC CHEMICAL INDUSTRY. LTD.) | 40.0 | 40.0 | 40.0 | 40.0 | POLYMERIZABLE COMPOUND (MONOFUNCTIONAL (METH)ACRYLATE) | MONOFUNCTIONAL-MONOMER |
| DPGDA | NK ESTER APG-100 (DIPROPYLENE GLYCOL DIACRYLATE, PRODUCT NAME, MANUFACTURED BY SHIN-NAKAMURA CHEMICAL CO., LTD.) | 17.6 | 24.1 | 24.1 | 18.1 | POLYMERIZABLE COMPOUND (POLYFUNCTIONAL (METH)ACRYLATE) | BIFUNCTIONAL MONOMER |
| A-DPH | A-DPH (DIPENTAERYTHRITOL HEXAACRYLATE, PRODUCT NAME, MANUFACTURED BY SHIN-NAKAMURA CHEMICAL CO., LTD.) | 8.0 | – | – | 8.0 | POLYMERIZABLE COMPOUND (POLYFUNCTIONAL (METH)ACRYLATE) | HEXAFUNCTIONAL MONOMER |
| Irgacure819 | IRGACURE 819 (PRODUCT NAME, MANUFACTURED BY BASF, SOLID CONTENT 100%) | 3.0 | 3.0 | 3.0 | 3.0 | PHOTOPOLYMERIZATION INITIATOR | – |
| DarocurTPO | DAROCURTPO (PRODUCT NAME, MANUFACTURED BY CHIBA SPECIALITY CHEMICALS K.K.) | 5.0 | 5.0 | 5.0 | 5.0 | PHOTOPOLYMERIZATION INITIATOR | – |
| Speedcure DETX | Speedcure DETX (PRODUCT NAME, MANUFACTURED BY LAMBSON LTD., SOLID CONTENT 100%) | 2.5 | 3.8 | 3.8 | 2.5 | PHOTOPOLYMERIZATION INITIATOR | – |
| BYK UV3500 | BYK-UV3500 (PRODUCT NAME, MANUFACTURED BY BYK JAPAN K.K.) | 0.5 | 0.5 | 0.5 | 0.5 | LEVELING AGENT (SURFACTANT) | – |
| SOL32000 | Solsperse 32000 (PRODUCT NAME, MANUFACTURED BY LUBRIZOL CORPORATION) | 1.0 | 1.0 | 1.0 | 1.0 | DISPERSANT | – |
| PB15:3 | IRGALITE BLUE GLVO (CYAN PIGMENT (C. I. PIGMENT BLUE 15:3), PRODUCT NAME, MANUFACTURED BY BASF) | 2.4 | – | – | – | CYAN PIGMENT | – |
| PY155 | Novoperm Yellow 4G01 (YELLOW PIGMENT (C. I. PIGMENT YELLOW 155), PRODUCT NAME, MANUFACTURED BY CLARIANT) | – | – | 2.6 | – | YELLOW PIGMENT | – |
| PR122 | CROMOPHTAL PinkPT (MAGENTA PIGMENT (C. I. PIGMENT RED 122), PRODUCT NAME, MANUFACTURED BY BASF) | – | 2.6 | – | – | MAGENTA PIGMENT | – |
| CB | MICROLITH-WA Black C-WA (BLACK PIGMENT (C. I. PIGMENT BLACK 7), PRODUCT NAME, MANUFACTURED BY BASF) | – | – | – | 1.9 | BLACK PIGMENT | – |
| | TOTAL (%) | 100.0 | 100.0 | 100.0 | 100.0 | | |

| Duty | 100% | 90% | 80% | 70% | 60% | 50% | 40% | 30% | 20% | 10% | 0% |
|---|---|---|---|---|---|---|---|---|---|---|---|
| Y | 0.0013 | 0.0024 | 0.0051 | 0.0107 | 0.0212 | 0.0418 | 0.0835 | 0.1578 | 0.3117 | 0.5797 | 1.0000 |
| Bk | 0.0023 | 0.0043 | 0.0083 | 0.0156 | 0.0296 | 0.0555 | 0.1039 | 0.1944 | 0.3576 | 0.6213 | 1.0000 |
| C | 0.0551 | 0.0753 | 0.1057 | 0.1440 | 0.1961 | 0.2703 | 0.3600 | 0.4723 | 0.6279 | 0.7990 | 1.0000 |
| M | 0.0377 | 0.0529 | 0.0768 | 0.1073 | 0.1724 | 0.2118 | 0.3006 | 0.4173 | 0.5777 | 0.7708 | 1.0000 |

FIG. 7

| CYAN | | | | | | | | | | | | |
|---|---|---|---|---|---|---|---|---|---|---|---|---|
| INTEGRATED LIGHT QUANTITY OF UV ($mJ/cm^2$) | 0 | 3 | 4 | 5 | 8.5 | 10 | 12 | 14 | 25 | 30 | 40 | 50 |
| BLEED | × | △ | △ | ○ | ○ | ○ | ○ | ○ | ○ | ○ | ○ | ○ |
| AGGREGATION | × | × | × | × | ○ | ○ | ○ | ○ | ○ | ○ | ○ | ○ |
| SOLIDIFICATION | ○ | ○ | ○ | △ | △ | △ | ○ | ○ | ○ | ○ | △ | △ |

| MAGENTA | | | | | | | | | | | | |
|---|---|---|---|---|---|---|---|---|---|---|---|---|
| INTEGRATED LIGHT QUANTITY OF UV ($mJ/cm^2$) | 0 | 3 | 4 | 5 | 8.5 | 10 | 12 | 14 | 25 | 30 | 40 | 50 |
| BLEED | × | △ | △ | ○ | ○ | ○ | ○ | ○ | ○ | ○ | ○ | ○ |
| AGGREGATION | ○ | ○ | ○ | ○ | ○ | ○ | ○ | ○ | ○ | ○ | ○ | ○ |
| SOLIDIFICATION | ○ | ○ | ○ | △ | △ | △ | ○ | ○ | ○ | ○ | △ | △ |

| BLACK | | | | | | | | | | | | |
|---|---|---|---|---|---|---|---|---|---|---|---|---|
| INTEGRATED LIGHT QUANTITY OF UV ($mJ/cm^2$) | 0 | 3 | 4 | 5 | 8.5 | 10 | 12 | 14 | 25 | 30 | 40 | 50 |
| BLEED | × | × | △ | ○ | ○ | ○ | ○ | ○ | ○ | ○ | ○ | ○ |
| AGGREGATION | ○ | ○ | ○ | ○ | ○ | ○ | ○ | ○ | ○ | ○ | ○ | ○ |
| SOLIDIFICATION | ○ | ○ | ○ | ○ | ○ | ○ | △ | × | × | × | × | × |

| YELLOW | | | | | | | | | | | | |
|---|---|---|---|---|---|---|---|---|---|---|---|---|
| INTEGRATED LIGHT QUANTITY OF UV ($mJ/cm^2$) | 0 | 3 | 4 | 5 | 8.5 | 10 | 12 | 14 | 25 | 30 | 40 | 50 |
| BLEED | × | × | × | △ | ○ | ○ | ○ | ○ | ○ | ○ | ○ | ○ |
| AGGREGATION | ○ | ○ | ○ | ○ | ○ | ○ | ○ | ○ | ○ | ○ | ○ | ○ |
| SOLIDIFICATION | ○ | △ | △ | × | × | × | × | × | × | × | × | × |

FIG. 8

| COLOR ORDER | SUBSTRATE | COVERAGE |
|---|---|---|
| MCKY | A | 49.6% |
| | B | 57.2% |
| CMKY | A | 51.2% |
| | B | 59.6% |

PRINTING APPARATUS

BACKGROUND

1. Technical Field

The present invention relates to a printing apparatus.

2. Related Art

Ink jet type printing apparatuses (line printers) that print an image on a medium by ejecting ink (UV ink), which is cured when the ink is irradiated with ultraviolet (UV) light, from plural heads aligned in a transport direction of the medium are known. In the printing apparatuses of this type, an image quality difference may be generated in an image to be printed depending on what color ink is ejected from which position of the head. For example, in JP-A-2004-268549, there is proposed an invention in which the quality of a printed image is improved by ejecting UV ink, which is not easily cured, from a head on a more upstream side in a transport direction and increasing an integrated light quantity of UV toward a downstream side in the transport direction. In addition, in JP-A-2007-276248, there is proposed an invention in which the quality of a printed image is improved by ejecting UV ink, which is not easily cured, from a head on a more upstream side in a transport direction and increasing an integrated light quantity of UV to be irradiated to the ink which is not easily cured in the transport process.

However, in JP-A-2004-268549 and JP-A-2007-276248, only the curability of the ink is considered and other properties are not considered. For example, phenomena such as solidification and aggregation occur in the UV ink in some cases, but the phenomena may also cause deterioration in quality of the printed image. That is, when an ink ejection order and an integrated light quantity of UV are determined by paying attention only to the curability of ink, it is difficult to print an image with sufficiently high quality.

SUMMARY

An advantage of some aspects of the invention is that a line printer which performs printing using UV ink can print an image with high quality in consideration of ink properties.

According to an aspect of the invention, there is provided a printing apparatus including: a supporting member which supports a medium; a transport device which transports the medium supported by the supporting member in a transport direction; a first head which ejects a first radiation curable type ink; a second head which is arranged on a downstream side of the first head in the transport direction and ejects a second radiation curable type ink; a third head which is arranged on the downstream side of the second head in the transport direction and ejects a third radiation curable type ink; a fourth head which is arranged on the downstream side of the third head in the transport direction and ejects a fourth radiation curable type ink; a first irradiation section which is arranged between the first head and the second head in the transport direction and irradiates radiation rays with an integrated light quantity to a degree at which the first ink ejected from the first head is not completely cured; a second irradiation section which is arranged between the second head and the third head in the transport direction and irradiates radiation rays with an integrated light quantity to a degree at which the second ink ejected from the second head is not completely cured; a third irradiation section which is arranged between the third head and the fourth head in the transport direction and irradiates radiation rays with an integrated light quantity to a degree at which the third ink ejected from the third head is not completely cured; and a fourth irradiation section which is arranged on the downstream side of the fourth head in the transport direction and irradiates radiation rays with an integrated light quantity to a degree at which wetting and spreading of the first to fourth inks respectively ejected from the first to fourth heads are stopped on the medium, in which the radiation rays respectively irradiated from the first irradiation section to the third irradiation section have a peak wavelength of 350 nm to 450 nm, and coloring materials included in the third ink and the fourth ink have higher absorption properties of the radiation rays with the peak wavelength than coloring materials included in the first ink and the second ink.

Other properties of the invention will become more apparent in the specification and the accompanying drawings.

BRIEF DESCRIPTION OF THE DRAWINGS

The invention will be described with reference to the accompanying drawings, wherein like numbers reference like elements.

FIG. 5 is a diagram illustrating a composition of each color UV ink of K, C, M, and Y used when printing is performed in a first embodiment.

FIG. 7 is an explanatory diagram illustrating a state in which bleeding and solidification occur in four color inks of K, C, M, and Y relative to an integrated light quantity of UV.

FIG. 8 is a diagram illustrating data in which gamuts are compared in a case in which ink ejection orders of cyan (C) and magenta (M) are changed.

DESCRIPTION OF EXEMPLARY EMBODIMENTS

Figure 1:
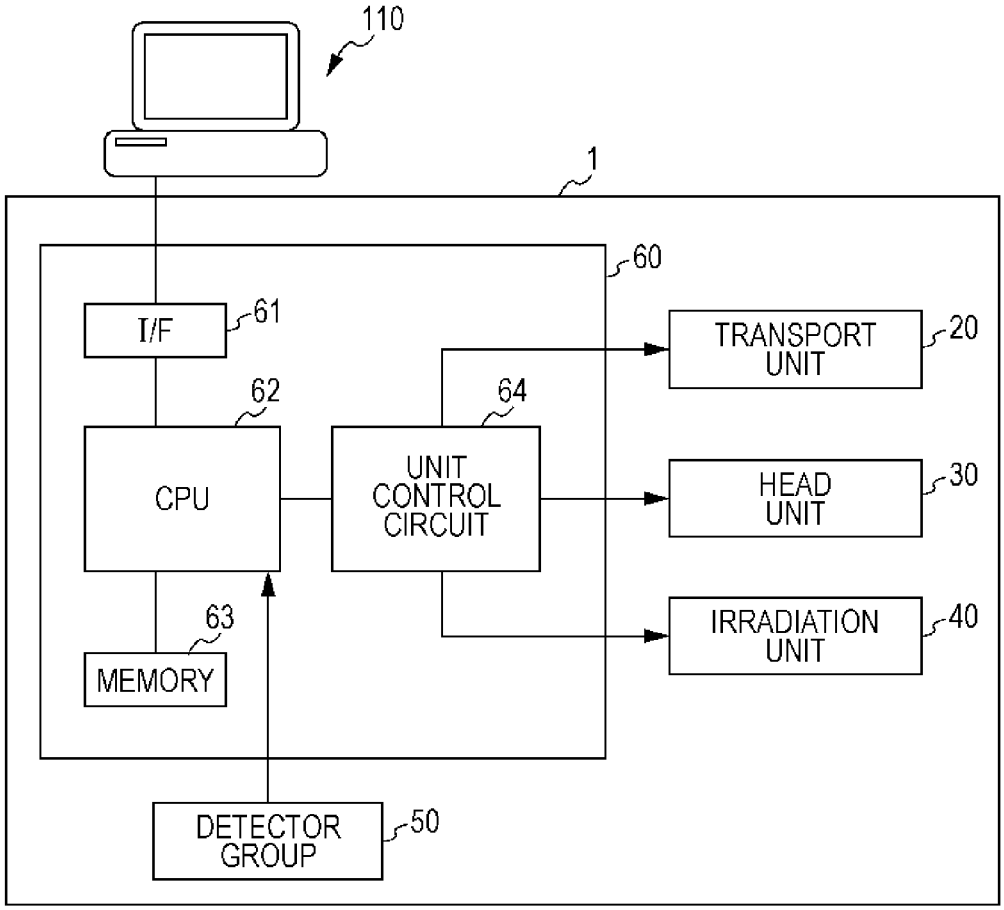
FIG. 1 is a block diagram illustrating the overall configuration of a printer.

According to the description of the present specification and the attached drawings, at least the following matters will be made apparent.

A printing apparatus includes a supporting member which supports a medium; a transport device which transports the medium supported by the supporting member in a transport direction; a first head which ejects a first radiation curable type ink; a second head which is arranged on a downstream side of the first head in the transport direction and ejects a second radiation curable type ink; a third head which is arranged on the downstream side of the second head in the transport direction and ejects a third radiation curable type ink; a fourth head which is arranged on the downstream side of the third head in the transport direction and ejects a fourth radiation curable type ink; a first irradiation section which is arranged between the first head and the second head in the transport direction and irradiates radiation rays with an integrated light quantity to a degree at which the first ink ejected from the first head is not completely cured; a second irradiation section which is arranged between the second head and the third head in the transport direction and irradiates radiation rays with an integrated light quantity to a degree at which the second ink ejected from the second head is not completely cured; a third irradiation section which is arranged between the third head and the fourth head in the transport direction and irradiates radiation rays with an integrated light quantity to a degree at which the third ink ejected from the third head is not completely cured; and a fourth irradiation section which is arranged on the downstream side of the fourth head in the transport direction and irradiates radiation rays with an integrated light quantity to a degree at which wetting and spreading of the first to fourth inks respectively ejected from the first to fourth heads are stopped on the medium, in which the radiation rays respectively irradiated from the first irradiation section to the third irradiation section have a peak wavelength of 350 nm to 450 nm, and coloring materials included in the third ink and the fourth ink have higher absorption properties of the radiation rays with the peak wavelength than coloring materials included in the first ink and the second ink.

According to such a printing apparatus, it is possible to print an image with high quality in consideration of the properties of the ink ejected from the printing apparatus.

In the printing apparatus, it is preferable that the fourth ink be yellow and the third ink be black.

According to such a printing apparatus, it is possible to print an image with high quality by suppressing the occurrence of solidification in the ink and the like.

In the printing apparatus, it is preferable that, when the first ink is magenta, the second ink be cyan, and when the first ink is cyan, the second ink be magenta.

According to such a printing apparatus, it is possible to print an image with high quality by suppressing the occurrence of solidification in the ink and the like.

In the printing apparatus, it is preferable that the integrated light quantity of the radiation rays irradiated from the first irradiation section and the second irradiation section be greater than the integrated light quantity of the radiation rays irradiated from the third irradiation section.

According to such a printing apparatus, it is possible to print an image with high quality by suppressing the occurrence of bleeding, solidification, aggregation and the like in the ink.

In the printing apparatus, it is preferable that an image printed when the first ink is set to cyan and the second ink is set to magenta have a wider gamut than an image printed when the first ink is set to magenta and the second ink is set to cyan.

According to such a printing apparatus, the color of the original data (image) is likely to be accurately reproduced and thus, it is possible to print an image with high quality.

In the printing apparatus, it is preferable that a distance between the first head and the first irradiation section in the transport direction be equal to a distance between the first irradiation section and the second head in the transport direction, a distance between the second head and the second irradiation section in the transport direction be equal to a distance between the second irradiation section and the third head in the transport direction, and a distance between the third head and the third irradiation section in the transport direction be equal to a distance between the third irradiation section and the fourth head in the transport direction.

According to such a printing apparatus, since the quality of a printed image is not easily affected by the positional relationship between each of the heads and the respective irradiation sections, the quality of the printed image is not easily deteriorated.

In the printing apparatus, it is preferable that the first ink be cyan, the second ink be magenta, the third ink be black, and the fourth ink be yellow.

According to such a printing apparatus, it is possible to print an image with high quality.

Basic Configuration of Printing Apparatus

A line printer (printer 1) will be described as an example of an embodiment of a printing apparatus which is used in the embodiment.

The printer 1 is a printing apparatus which records an image by ejecting a liquid such as ink toward a medium to be recorded (hereinafter, simply referred to as a medium) such as paper, cloth, or a film sheet. The printer 1 is an ink jet type printer, but the ink jet type printer may be an apparatus which adopts any ejecting method as long as it is a printing apparatus in which printing is possible by ejecting ink.

FIG. 1 is a block diagram of the overall configuration of the printer 1. The printer 1 has a transport unit 20, a head unit 30, an irradiation unit 40, a detector group 50, and a controller 60. The controller 60 is a control section which controls each of the units such as the head unit 30 and the irradiation unit 40 based on printing data which is received from a computer 110 which is an external device. The circumstances in the printer 1 are monitored using the detector group 50 and the detector group 50 outputs the detection result to the controller 60. The controller 60 controls each of the units based on the detection result which is output from the detector group 50.

Computer 110

The printer 1 is connected so as to be able to communicate with the computer 110 which is an external device. A printer driver is installed in the computer 110. The printer driver is a program for displaying a user interface on a display device and for converting image data which is output from the application program into printing data. The printer driver is recorded in a recording medium (a recording medium which can be read by a computer) such as a flexible disc FD or a CD-ROM. In addition, the printer driver is able to be downloaded to the computer 110 via the Internet. Here, the program is configured with codes for realizing various types of functions.

The computer 110 outputs the printing data to the printer 1 according to the image to be printed in order for the printer 1 to print the image. The printing data is data with a format which is able to be interpreted by the printer 1 and has various types of command data and pixel data. The command data is data for instructing the execution of specific operations to the printer 1. As the command data, for example, there are command data which instructs the supply of the medium, command data which indicates the medium transport amount, and command data which instructs the medium ejection. In addition, the pixel data is data which relates to the pixels of the image to be printed.

Here, the pixel is a unit element which configures an image and the image is configured by aligning the pixels in a two dimensional manner. The pixel data in the printing data is data (for example, gradation values) which relates to dots which are formed on the medium (for example, paper S or the like). The pixel data is configured by, for example, data of two bits for each pixel. The pixel data of two bits is data which can express one pixel as four gradations.

Transport Unit 20

Figure 2:
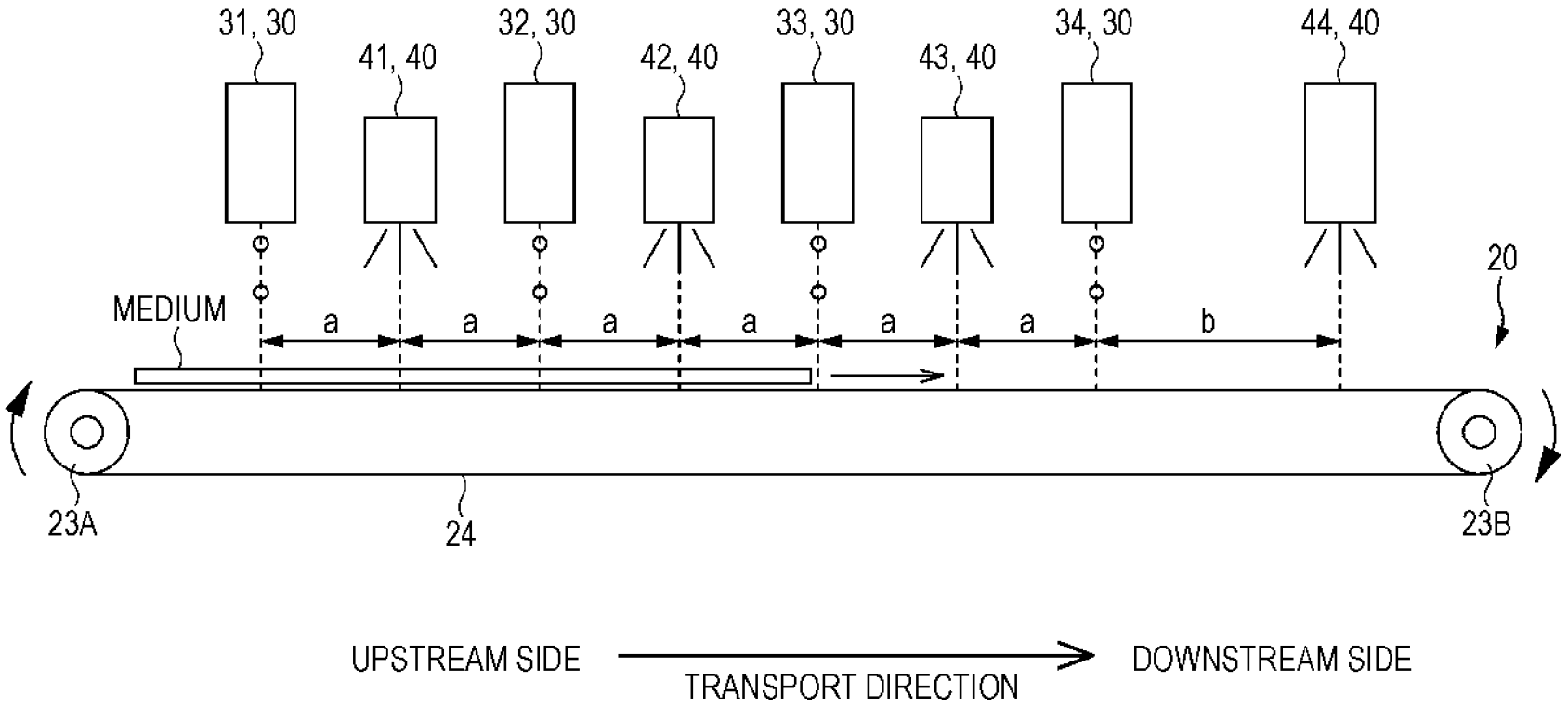
FIG. 2 is a schematic side view illustrating the basic configuration of the printer.

FIG. 2 is a schematic side view illustrating the basic configuration of the printer 1.

The transport unit 20 is for transporting the medium in a predetermined direction (referred to below as a transport direction) while supporting the medium. That is, the transport unit 20 relatively moves the medium with respect to the head unit 30 (described later) which is fixed upward while supporting the medium. The transport unit 20 has an upstream side transport roller 23A on an upstream side in the transport direction, a downstream side transport roller 23B on a downstream side in the transport direction, and a belt 24 (FIG. 2). When a transport motor (not illustrated) is rotated, the upstream side transport roller 23A and the downstream side transport roller 23B rotate and the belt 24 is rotated. The medium which is fed using medium feeding rollers (not illustrated) is transported to a region where printing is possible (a region which opposes the head unit 30 and the like which will be described later) by the belt 24. The medium which has passed through the region where printing is possible is ejected to the outside by the belt 24. Here, the medium during transportation is electrostatically adsorbed or vacuum adsorbed to the belt 24. That is, the belt 24 is also a supporting member which supports a medium.

Head Unit 30

The head unit 30 is for ejecting the ink to the medium. The head unit 30 is provided for each color ink and forms a large number of ink dots (ink droplets) by ejecting each color ink with regard to the medium during transportation to print the image on the medium. The printer 1 that is illustrated in FIG. 2 is a line printer and the head unit 30 is fixed to an upper part of the medium to be transported. Each head of the head unit 30 can form dots to the extent of the width of the medium at one time. The head unit 30 of the embodiment includes four heads of a first head 31, a second head 32, a third head 33, and a fourth head 34.

As illustrated in FIG. 2, the first head 31 which ejects a first ink is arranged on the most upstream side in the transport direction in the printer 1. Then, the second head 32 which ejects a second ink is arranged on the downstream side of the first head 31 in the transport direction. In the same manner, the third head 33 which ejects a third ink is arranged on the downstream side of the second head 32 in the transport direction, and the fourth head 34 which ejects a fourth ink is arranged on the downstream side of the third head 33 in the transport direction. That is, four heads of the first head 31 to the fourth head 34 are aligned in the transport direction in order, and the first to fourth inks are ejected in order while the medium is transported by the transport unit 20.

In the embodiment, the ink ejected from the head unit 30 is a radiation curable type ink which is cured when the ink is irradiated with radiation rays. In the specification, an example in which printing is performed using ultraviolet curable ink (hereinafter, also referred to as UV ink) that is cured by the irradiation of ultraviolet (UV) light is described. The details of the ultraviolet curable ink (UV ink) will be described later.

Each of the heads are configured with plural short length heads and each of the short length heads are provided with plural nozzles which are ejection outlets for ejecting the UV ink.

Figure 3A:
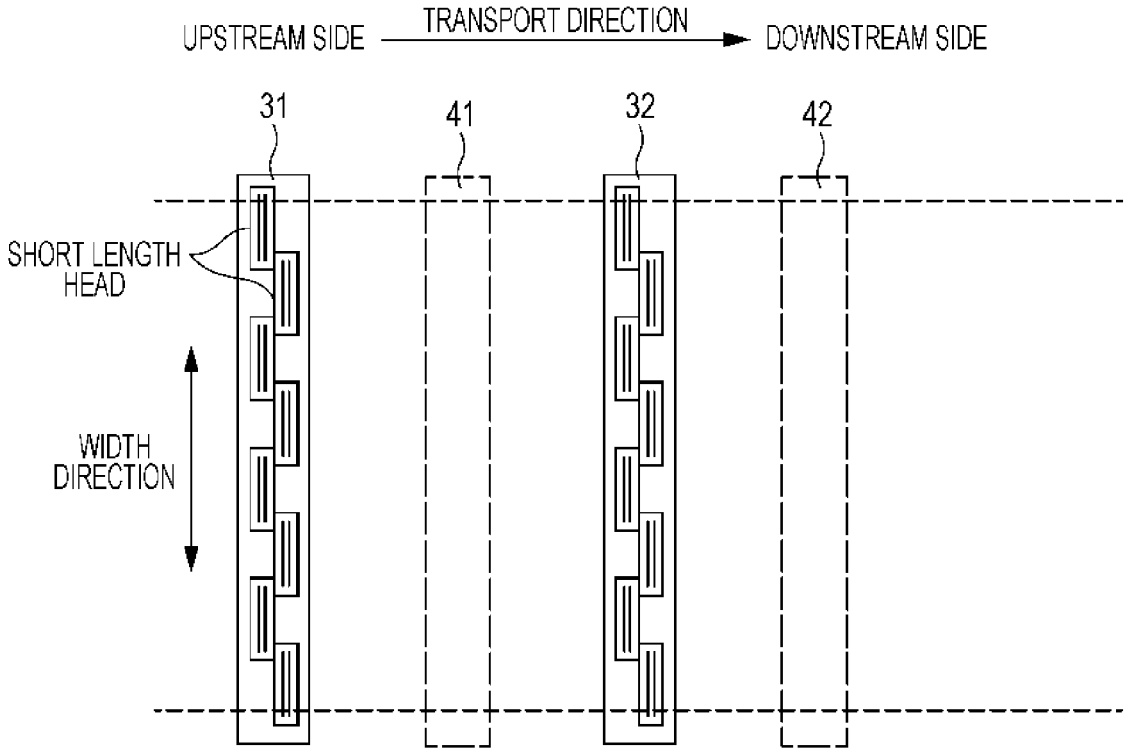
FIG. 3A is an explanatory diagram illustrating the arrangement of plural short length heads of a first head and a second head in a head unit.
Figure 3B:
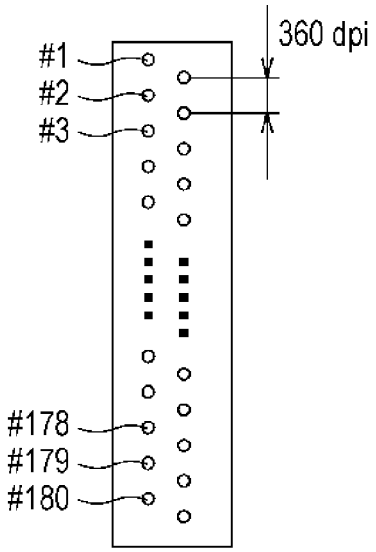
FIG. 3B is an explanatory diagram illustrating an appearance of nozzle arrays arranged on a lower surface of each short length head.
Figure 4:
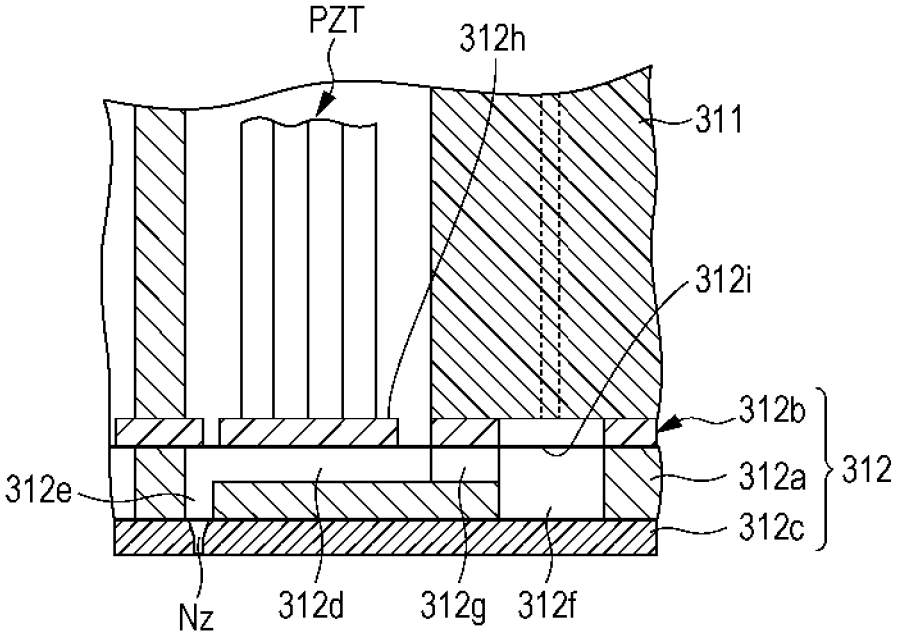
FIG. 4 is a cross-sectional view illustrating the configuration of the short length head.

FIG. 3A is an explanatory diagram illustrating the arrangement of the plural short length heads of the first head 31 and the second head 32 in the head unit 30. FIG. 3B is an explanatory diagram illustrating an appearance of nozzle arrays arranged on a lower surface of each of the short length heads. Here, FIGS. 3A and 3B are diagrams where the nozzles are virtually viewed from an upper surface. FIG. 4 is a cross-sectional view illustrating the configuration of the short length head.

In the first head 31, eight short length heads are aligned in a zigzag shape along the width direction of the medium which is a direction which intersects with the transport direction of the medium. In the same manner, eight short length heads are aligned in a zigzag shape also in the second head 32. However, the number of short length heads which configure each of the heads may be more than eight or may be less than eight.

Plural nozzles arrays are formed for each of the short length heads (FIG. 3B). The nozzle arrays are each provided with 180 nozzles which eject ink and the nozzles are aligned up with a constant nozzle pitch (for example, 360 dpi) from #1 to #180 along the width direction of the medium. In a case of FIG. 3B, two rows of nozzle arrays are aligned in parallel and the nozzles of each of the nozzle arrays are provided in positions which are each shifted by 720 dpi in the width direction of the medium. Here, the number of nozzles in one row is not limited to 180. For example, 360 nozzles may be provided in one row or 90 nozzles may be provided. In addition, the number of nozzle arrays which are provided in each of the short length heads is not limited to two rows.

Each of the short length heads has a case 311, a flow channel unit 312, and a piezo element group PZT (FIG. 4). The case 311 accommodates the piezo element group PZT and the flow channel unit 312 is joined to the lower surface of the case 311. The flow channel unit 312 includes a channel forming plate 312*a*, an elastic plate 312*b*, and a nozzle plate 312*c*. A groove that is a pressure chamber 312*d*, a through-hole that is a nozzle connection hole 312*e*, a through-hole that is a common ink chamber 312*f*, and a groove that is an ink supply channel 312*g* are formed on the channel forming plate 312*a*. The elastic plate 312*b* has an island portion 312*h* with which the tip end of the piezo element PZT is joined. An elastic region is formed by an elastic film 312*i* around the island portion 312*h*. The ink stored in the ink cartridge is supplied to the pressure chamber 312*d* corresponding to each of the nozzles Nz through the common ink chamber 312*f*. The nozzle plate 312*c* is a plate where the nozzles Nz are formed.

The piezo element group includes plural pectinate piezo elements PZT (driving elements) and the number of piezo element groups corresponding to the number of the nozzles Nz is provided. The piezo element groups are driven by a driving signal generated by a unit control circuit 64. Specifically, the driving signal is applied to the piezo elements PZT by a flexible cable (not illustrated) which is a wiring substrate and the piezo elements are extended or contracted vertically in accordance with the potential of the driving signal. As the piezo elements PZT are extended or contracted, the island portion 312*h* illustrated in FIG. 4 is pushed to the pressure chamber 312*d* or pulled in the opposite direction. At this time, the elastic film 312*i* around the island portion 312*h* is deformed, and the internal pressure of the pressure chamber 312*d* increases or decreases, such that ink droplets are ejected from the nozzles.

Irradiation Unit 40

The irradiation unit 40 is for irradiating the UV ink dots, which have been ejected from the head unit 30 and have landed on the medium, with UV. The dots which have been formed on the medium are cured by receiving UV irradiation from the irradiation unit 40. In the embodiment, the irradiation unit 40 includes a first irradiation section 41, a second irradiation section 42, a third irradiation section 43, and a fourth irradiation section 44.

As shown in FIG. 2, the first irradiation section 41 is arranged on the downstream side of the first head 31 in the transport direction and on the upstream side of the second head 32 in the transport direction. Then, the first ink (ink dots) ejected from the first head 31 on the medium is irradiated with UV with an integrated light quantity to a degree at which the first ink is not completely cured (for example, a degree of curing the surface of the ink dot). Hereinafter, such curing is also referred to as "pre-curing". In the embodiment, as ultraviolet (UV) light for pre-curing, UV having a peak wavelength of 350 nm to 450 nm is irradiated.

In the same manner, the second irradiation section 42 is arranged on the downstream side of the second head 32 in the transport direction and on the upstream side of the third head 33 in the transport direction and the second ink (ink dots) ejected from the second head 32 on the medium is irradiated with UV with an integrated light quantity for pre-curing. The third irradiation section 43 is arranged on the downstream side of the third head 33 in the transport direction and on the upstream side of the fourth head 34 in the transport direction and the third ink (ink dots) ejected from the third head 33 on the medium is irradiated with UV with an integrated light quantity for pre-curing. That is, the first irradiation section 41 to the third irradiation section 43 are pre-curing irradiation sections respectively corresponding to the first head 31 to the third head 33. Here, the integrated light quantity represents an integrated quantity of light to be irradiated per unit area on the medium.

The fourth irradiation section 44 is provided on the downstream side of the fourth head 34 in the transport direction and irradiates UV with an integrated light quantity to a degree at which wetting and spreading of the first to fourth inks ejected from the first head 31 to the fourth head 34 are stopped on the medium. Hereafter, such curing is also referred to as "main curing". In most cases, UV for main curing is irradiated with stronger irradiation energy than the UV for pre-curing. Thus, the pre-cured inks are completely cured, and an image is fixed on the medium. In the embodiment, the fourth irradiation section 44 is a main curing irradiation section mainly for curing the inks ejected from the first head 31 to the fourth head 34.

In the printer 1, a pre-curing irradiation section which corresponds to the fourth head 34 is not provided. The reason will be described later.

The irradiation unit 40 includes light emitting diodes (LED) as a light source of UV irradiation. It is possible for the LED to easily change the irradiation energy by controlling the size of the input current. The UV ink dots can be cured to an appropriate hardness by controlling the intensity of the UV irradiation. In addition, as a light source of the UV irradiation of the fourth irradiation section 44 which is the main curing irradiation section, a lamp (such as a metal halide lamp, a mercury lamp, or the like) may be used.

In the printer 1 of the embodiment, distances between each of the heads and the respective irradiation sections in the transport direction are equal. As shown in FIG. 2, a distance between the first head 31 and the first irradiation section 41 in the transport direction is a, and a distance between the first irradiation section 41 and the second head 32 is also a. In the same manner, a distance between the second head 32 and the second irradiation section 42, a distance between the second irradiation section 42 and the third head 33, a distance between the third head 33 and the third irradiation section 43, and a distance between the third irradiation section 43 and the fourth head 34 are all a. However, a distance between the fourth head 34 and the fourth irradiation section 44 is b ($a<b$). This is because the fourth irradiation section 44 irradiates UV for main curing, unlike other irradiation sections.

In the printer 1, since the distances between the heads and the irradiation sections (pre-curing irradiation sections) in the transport direction are equal, the quality of a printed image is less affected by the positional relationship between each of the heads and the respective irradiation sections.

Detector Group 50

A rotary type encoder (not illustrated), a medium detection sensor (not illustrated), and the like are included in the detector group 50. The rotary type encoder detects the rotation amount of the upstream side transport roller 23A and the downstream side transport roller 23B. It is possible to detect the transport amount of the medium based on the detection result of the rotary type encoder. The medium detection sensor detects the position of the tip end of the medium during feeding of the medium.

Controller 60

The controller 60 is a control unit (control section) for performing control of the printer. The controller 60 has an interface section 61, a CPU 62, a memory 63, and a unit control circuit 64.

The interface section 61 performs transmission and reception of data between the computer 110 which is an external device and the printer 1. The CPU 62 is a computation processing device for performing control of the entirety of the printer 1. The memory 63 is for securing a region which stores a program of the CPU 62, an operation region, and the like and is configured by a storage element such as RAM or EEPROM. Then, the CPU 62 controls each of the units such as the transport unit 20 through the unit control circuit 64 according to the program which is stored in the memory 63.

Regarding UV Ink

As the ultraviolet curable ink (UV ink) used for printing in the embodiment, the following compositions are generally used. In the following description, "(meth)acrylate" has the meaning of at least any one of acrylate and methacrylate which corresponds thereto and "(meth)acryl" has the meaning of at least any one of acryl and methacryl which corresponds thereto.

In the following description, "curability" refers to a property of polymer curing using the irradiation of light with or without the presence of a photopolymerization initiator. "Ejection stability" refers to a property of ejecting stable ink droplets from the nozzles normally without clogging of the nozzle.

Polymerizable Compound

The polymerizable compound which is included in the ink composition of the embodiment is polymerized during the ultraviolet light irradiation by the action of the photopolymerization initiator which will be described later, and the ink dots formed on the medium can be cured.

Monomer A

The monomer A which is the essential polymerizable compound in the embodiment is a vinyl ether group-containing (meth)acrylate ester type and is represented by the following general formula (I).

$$CH2=CR1\text{-}COOR2\text{-}O\text{—}CH\text{=}CH\text{—}R3 \quad (I)$$

(In the formula, R1 is a hydrogen atom or a methyl group, R2 is a divalent organic residue with 2 to 20 carbon atoms, and R3 is a hydrogen atom or a monovalent organic residue with 1 to 11 carbon atoms)

It is possible to obtain good curability in the ink as a result of the monomer A being contained in the ink composition.

In the above-described general formula (I), as the divalent organic residue with 2 to 20 carbon atoms represented by R2, a linear, branched or cyclic alkylene group with 2 to 20 carbon atoms, an alkylene group with 2 to 20 carbon atoms which has an oxygen atom using an ether bond and/or an ester bond in the structure, or a divalent aromatic group with 6 to 11 carbon atoms which may be substituted is preferable. Among the above, an alkylene group with 2 to 6 carbon atoms such as an ethylene group, an n-propylene group, an isopropylene group, or a butylene group, or an alkylene group with 2 to 9 carbon atoms which has an oxygen atom using an ether bond in a structure such as an oxyethylene group, an oxy-n-propylene group, an oxyisopropylene group, or an oxybutylene group, is preferably used.

In the above-described general formula (I), as the monovalent organic residue with 1 to 11 carbon atoms represented by R3, a linear, branched or cyclic alkyl group with 1 to 10 carbon atoms, or an aromatic group with 6 to 11 carbon atoms which may be substituted is preferable. Among the above, an alkyl group with 1 to 2 carbon atoms which is a methyl group or an ethyl group, or an aromatic group with 6 to 8 carbon atoms such as a phenyl group or a benzyl group is preferably used.

In the case of groups in which the above-described organic residue may be substituted, the substituent groups may be divided into groups which include carbon atoms and groups which do not include carbon atoms. First, in a case where the above-described substituent group is a group which includes carbon atoms, the carbon atoms are counted in the number of carbon atoms of the organic residue. The groups which include carbon atoms are not limited to the following; however, examples thereof include a carboxyl group, an alkoxy group, or the like. Next, the groups which do not include carbon atoms are not limited to the following; however, examples thereof include a hydroxyl group, or a halo group.

The above-described monomer A is not limited to the following; however, examples thereof include (meth)acrylic acid 2-vinyloxy ethyl, (meth)acrylic acid 3-vinyloxy propyl, (meth)acrylic acid 1-methyl-2-vinyloxy ethyl, (meth)acrylic acid 2-vinyloxy propyl, (meth)acrylic acid 4-vinyloxy butyl, (meth)acrylic acid 1-methyl-3-vinyloxy propyl, (meth) acrylic acid 1-vinyloxy methyl propyl, (meth)acrylic acid 2-methyl-3-vinyloxy propyl, (meth)acrylic acid 1,1-dimethyl-2-vinyloxy ethyl, (meth)acrylic acid 3-vinyloxy butyl, (meth)acrylic acid 1-methyl-2-vinyloxy propyl, (meth) acrylic acid 2-vinyloxy butyl, (meth)acrylic acid 4-vinyloxy cyclo hexyl, (meth)acrylic acid 6-vinyloxy hexyl, (meth) acrylic acid 4-vinyloxy methyl cyclohexyl methyl, (meth) acrylic acid 3-vinyloxy methyl cyclo hexyl methyl, (meth) acrylic acid 2-vinyloxy methyl cyclo hexyl methyl, (meth) acrylic acid p-vinyloxy methyl phenyl methyl, (meth)acrylic acid m-vinyloxy methyl phenyl methyl, (meth)acrylic acid o-vinyloxy methyl phenyl methyl, (meth)acrylic acid 2-(vinyloxy ethoxy) ethyl, (meth)acrylic acid 2-(vinyloxy isopropoxy) ethyl, (meth)acrylic acid 2-(vinyloxy ethoxy) propyl, (meth)acrylic acid 2-(vinyloxy ethoxy) isopropyl, (meth) acrylic acid 2-(vinyloxy isopropoxy) propyl, (meth)acrylic acid 2-(vinyloxy isopropoxy) isopropyl, (meth)acrylic acid 2-(vinyloxy ethoxy ethoxy) ethyl, (meth)acrylic acid 2-(vinyloxy ethoxy isopropoxy) ethyl, (meth)acrylic acid 2-(vinyloxy isopropoxy ethoxy) ethyl, (meth)acrylic acid 2-(vinyloxy isopropoxy isopropoxy) ethyl, (meth)acrylic acid 2-(vinyloxy ethoxy ethoxy) propyl, (meth)acrylic acid 2-(vinyloxy ethoxy isopropoxy) propyl, (meth)acrylic acid 2-(vinyloxy isopropoxy ethoxy) propyl, (meth)acrylic acid 2-(vinyloxy isopropoxy isopropoxy) propyl, (meth)acrylic acid 2-(vinyloxy ethoxy ethoxy) isopropyl, (meth)acrylic acid 2-(vinyloxy ethoxy isopropoxy) isopropyl, (meth)acrylic acid 2-(vinyloxy isopropoxy ethoxy) isopropyl, (meth) acrylic acid 2-(vinyloxy isopropoxy isopropoxy) isopropyl, (meth)acrylic acid 2-(vinyloxy ethoxy ethoxy ethoxy) ethyl, (meth)acrylic acid 2-(vinyloxy ethoxy ethoxy ethoxy ethoxy) ethyl, (meth)acrylic acid 2-(isopropenoxy ethoxy) ethyl, (meth)acrylic acid 2-(isopropenoxy ethoxy ethoxy) ethyl, (meth)acrylic acid 2-(isopropenoxy ethoxy ethoxy ethoxy) ethyl, (meth)acrylic acid 2-(isopropenoxy ethoxy ethoxy ethoxy ethoxy) ethyl, (meth)acrylic acid polyethylene glycol monovinyl ether, and (meth)acrylic acid polypropylene glycol monovinyl ether.

Among the above, due to having a high flash point at low viscosity and excellent curability, (meth)acrylic acid 2-(vinyloxy ethoxy) ethyl, that is, at least any one of acrylic acid 2-(vinyloxy ethoxy) ethyl and methacrylic acid 2-(vinyloxy ethoxy) ethyl, is preferable, and acrylic acid 2-(vinyloxy ethoxy) ethyl is more preferable. Examples of the (meth) acrylic acid 2-(vinyloxy ethoxy) ethyl include (meth)acrylic acid 2-(2-vinyloxy ethoxy) ethyl and (meth)acrylic acid 2-(1-vinyloxy ethoxy) ethyl, and examples of the acrylic acid 2-(vinyloxy ethoxy) ethyl include acrylic acid 2-(2-vinyloxy ethoxy) ethyl (hereinafter, also referred to as "VEER") and acrylic acid 2-(1-vinyloxy ethoxy) ethyl.

The method of manufacturing the monomer A is not limited to the following; however, examples thereof include a method (method B) of esterifying the (meth)acrylic acid and a hydroxyl group-containing vinyl ether, a method (method C) of esterifying a (meth)acrylic acid halide and the hydroxyl group-containing vinyl ether, a method (method D) of esterifying a (meth)acrylic acid anhydride and the hydroxyl group-containing vinyl ether, a method (method E) of ester replacing a (meth)acrylic acid ester and the hydroxyl group-containing vinyl ether, a method (method F) of esterifying a (meth) acrylic acid and a halogen-containing vinyl ether, a method (method G) of esterifying a (meth)acrylic acid alkali (earth) metal salt and a halogen-containing vinyl ether, a method (method H) of vinyl replacing a hydroxyl group-containing (meth)acrylic acid ester and a vinyl carboxylic acid, and a method (method I) of ether replacing a hydroxyl group-containing (meth)acrylic acid ester and an alkyl vinyl ether.

Polymerizable Compounds Other than Monomer a

In addition, other than the above-described vinyl ether group-containing (meth)acrylic acid ester (monomer A), it is also possible to use various types of well-known monofunctional, bifunctional, or trifunctional or greater polyfunctional monomers and oligomers (hereinafter, referred to as "other polymerizable compounds"). Examples of the above-described monomers include unsaturated carboxylic acids such as (meth)acrylic acid, itaconic acid, crotonic acid, isocrotonic acid, maleic acid, and salts thereof, or esters, urethanes, amides and anhydrides thereof, acrylonitrile, styrene, various unsaturated polyesters, unsaturated polyethers, unsaturated polyamides, and unsaturated urethanes. In addition, examples of the above-described oligomers include oligomers which are formed from the above-described monomers such as linear acrylic oligomers, epoxy (meth)acrylate, oxetane (meth)acrylate, aliphatic urethane (meth)acrylate, aromatic urethane (meth)acrylate, and polyester (meth)acrylate.

In addition, the other monofunctional monomers and polyfunctional monomers may include N-vinyl compounds. Examples of the N-vinyl compounds include N-vinyl formamide, N-vinyl carbazole, N-vinyl acetamide, N-vinyl pyrrolidone, N-vinyl caprolactam, acryloyl morpholine, derivatives thereof, and the like.

Among the other polymerizable compounds, esters of (meth)acrylic acid, that is, (meth)acrylate, are preferable.

Among the above-described (meth)acrylates, examples of monofunctional (meth)acrylates include isoamyl (meth)acrylate, stearyl (meth)acrylate, lauryl (meth)acrylate, octyl (meth)acrylate, decyl (meth)acrylate, isomyristyl (meth) acrylate, isostearyl (meth)acrylate, 2-ethyl hexyl-diglycol (meth)acrylate, 2-hydroxybutyl (meth)acrylate, butoxy ethyl (meth)acrylate, ethoxy-diethylene glycol (meth)acrylate, methoxy diethylene glycol (meth)acrylate, methoxy polyethylene glycol (meth)acrylate, methoxy propylene glycol (meth)acrylate, phenoxyethyl (meth)acrylate, tetrahydrofurfuryl (meth)acrylate, isobornyl (meth)acrylate, 2-hydroxyethyl (meth)acrylate, 2-hydroxypropyl (meth)acrylate, 4-hydroxybutyl (meth)acrylate, 2-hydroxy-3-phenoxypropyl (meth)acrylate, lactone-modified flexible (meth)acrylate, t-butyl cyclohexyl (meth)acrylate, dicyclopentanyl (meth) acrylate, and dicyclopentenyloxyethyl (meth)acrylate.

Among the above-described (meth)acrylates, examples of the bifunctional (meth)acrylates include triethylene glycol di(meth)acrylate, tetraethylene glycol di(meth)acrylate, polyethylene glycol di(meth)acrylate, dipropylene glycol di(meth)acrylate, tripropylene glycol di(meth)acrylate, polypropylene glycol di(meth)acrylate, 1,4-butanediol di(meth)acrylate, dicyclopentanyl di(meth)acrylate, 1,6-hexanediol di(meth)acrylate, 1,9-nonanediol di(meth)acrylate, neopentyl glycol di(meth)acrylate, dimethylol-tricyclodecane di(meth)acrylate, EO (ethylene oxide) adduct di(meth) acrylate of bisphenol A, PO (propylene oxide) adduct di(meth)acrylate of bisphenol A, hydroxypivalic acid neopentyl glycol di(meth)acrylate, polytetramethylene glycol di(meth)acrylate, and an acrylated amine compound which is obtained by reacting a 1,6-hexanediol di(meth)acrylate and an amine compound. Here, examples of commercially available acrylated amine compounds which are obtained by reacting 1,6-hexane diol di(meth)acrylate and an amine compound include EBECRYL 7100 (a compound containing two amino groups and two acryloyl groups, manufactured by Cytech, Inc., product name) and the like.

Among the above-described (meth)acrylates, examples of the trifunctional or greater polyfunctional (meth)acrylates include trimethylolpropane tri(meth)acrylate, EO-modified trimethylolpropane tri(meth)acrylate, pentaerythritol tri (meth)acrylate, isocyanuric acid EO-modified tri(meth)acrylate, pentaerythritol tetra(meth)acrylate, dipentaerythritol hexa(meth)acrylate, ditrimethylolpropane tetra(meth)acrylate, glycerin propoxy tri(meth)acrylate, caprolactone modified trimethylolpropane tri(meth)acrylate, pentaerythritol ethoxy tetra(meth)acrylate, and caprolactam modified dipentaerythritol hexa (meth)acrylate.

In addition, among the above, the other polymerizable compounds preferably include a monofunctional (meth)acrylate. In this case, the ink composition has a low viscosity and excellent solubility with the photopolymerization initiator and other additives, and is able to easily obtain ejection stability. Furthermore, since the toughness of the ink coating film, the heat resistance, and the chemical resistance are increased, combining the monofunctional (meth)acrylate and the bifunctional (meth)acrylate is more preferable.

Furthermore, the above-described monofunctional (meth) acrylate preferably has one or more types of skeletons which are selected from a group consisting of an aromatic ring skeleton, a saturated alicyclic skeleton, and an unsaturated alicyclic skeleton. By the above-described other polymerizable compound being a monofunctional (meth)acrylate which has the above-described skeleton, it is possible to decrease the viscosity of the ink composition.

Examples of a monofunctional (meth)acrylate which has the aromatic ring skeleton include phenoxyethyl (meth)acrylate and 2-hydroxy-3-phenoxypropyl (meth)acrylate. In addition, examples of a monofunctional (meth)acrylate which has a saturated alicyclic skeleton include isobornyl (meth)acrylate, t-butyl cyclohexyl (meth)acrylate, and dicyclopentanyl (meth)acrylate. In addition, examples of a monofunctional (meth)acrylate which has an unsaturated alicyclic skeleton include dicyclopentenyloxyethyl (meth)acrylate.

Among the above, since it is possible to decrease the viscosity and odor, phenoxyethyl (meth)acrylate is preferable.

The content of the polymerizable compounds other than the monomer A is preferably 10 to 35 mass % with respect to the total amount (100 mass %) of the ink composition. When the content is within the above-described range, the solubility of the additives is excellent, and the toughness of the ink coating film, heat resistance, and the chemical resistance are excellent.

The above-described polymerizable compound may be used alone as one type or may be combined as two or more types.

Photopolymerization Initiator

The photopolymerization initiator included in the ink composition of the embodiment is used in order to form text by curing the ink which is present on the surface of the medium to be recorded using photopolymerization due to the irradiation of ultraviolet light. By using ultraviolet (UV) light in the radiation rays, the safety is excellent and it is possible to suppress the cost of the light source lamp.

As described above, the above-described photopolymerization initiator contains an acylphosphine based photopolymerization initiator and a thioxanthone based photopolymerization initiator. In this manner, it is possible to have excellent ink curability and also to prevent initial coloration of the cured film after printing.

In addition thereto, as described above, the total content of the acylphosphine based photopolymerization initiator and a thioxanthone based photopolymerization initiator is 9 to 14 mass % with respect to the total amount (100 mass %) of the ink composition, preferably 10 to 13 mass %, and more preferably 11 to 13 mass %. In a case in which the total content in the above inks is within the above-described range, the curability and the ejection stability of the ink are particularly excellent. In particular, when the content is 9 mass % or more, the viscosity is comparatively high and it is possible to prevent an increase in mist which is a cause of contamination of the image, and thus, the ejection stability of the ink is excellent.

Acylphosphine Based Photopolymerization Initiator

The photopolymerization initiator in the embodiment includes an acylphosphine based photopolymerization initiator, that is, an acylphosphine oxide based photopolymerization initiator (hereinafter, simply referred to as an "acylphosphine oxide"). In this manner, the curability of the ink is particularly excellent, and it is possible to prevent the initial coloration of the cured film after printing and the coloration over time of the cured film (the degree of initial coloration of the cured film is reduced).

The acylphosphine oxide is not particularly limited; however, examples thereof include 2,4,6-trimethyl benzoyl diphenyl phosphine oxide, 2,4,6-triethylbenzoyl diphenyl phosphine oxide, 2,4,6-triphenyl benzoyl diphenyl phosphine oxide, bis(2,4,6-trimethyl benzoyl)-phenyl phosphine oxide, and bis-(2,6-dimethoxy benzoyl)-2,4,4-trimethylpentyl phosphine oxide.

Examples of commercially available products of the acylphosphine oxide based photopolymerization initiator include DAROCUR TPO (2,4,6-trimethyl benzoyl-diphenylphosphine oxide), IRGACURE 819 (bis(2,4,6-trimethyl benzoyl)-phenyl phosphine oxide), and CGI 403 (bis(2,6-dimethoxy benzoyl)-2,4,4-trimethylpentyl phosphine oxide).

In addition, the above-described acylphosphine oxide preferably includes monoacylphosphine oxide. In this manner, the photopolymerization initiator is sufficiently dissolved and the curing proceeds sufficiently, whereby the curability of the ink is excellent.

The monoacylphosphine oxide is not particularly limited; however, examples thereof include 2,4,6-trimethyl benzoyl-diphenyl phosphine oxide, 2,4,6-triethylbenzoyl-diphenyl phosphine oxide, and 2,4,6-triphenyl benzoyl-diphenylphosphine oxide. Among the above, 2,4,6-trimethyl benzoyl-diphenyl phosphine oxide is preferable.

Examples of commercially available products of monoacylphosphine oxide include DAROCUR TPO (2,4,6-trimethyl benzoyl-diphenyl phosphine oxide).

Since the solubility with the polymerizable compound and the curability of the inner portion of the ink coating film are excellent and the degree of initial coloration is reduced, the photopolymerization initiator in the embodiment is preferably a monoacylphosphine oxide or a mixture of a monoacylphosphine oxide and a bisacylphosphine oxide.

Here, the above-described bisacylphosphine oxide is not particularly limited; however, examples thereof include bis(2,4,6-trimethyl benzoyl)-phenyl phosphine oxide and bis(2,6-dimethoxybenzoyl)-2,4,4-trimethylpentyl phosphine oxide. Among the above, bis(2,4,6-trimethyl benzoyl)-phenyl phosphine oxide is preferable.

The content of the acylphosphine oxide is preferably in a range of 8 to 11 mass % with respect to the total amount (100 mass %) of the ink composition, and more preferably in a range of 10 to 11 mass %. When the content is within the above-described range, the curability of the ink is excellent and the degree of initial coloration of the curing film is small.

Thioxanthone Based Photopolymerization Initiator

The photopolymerization initiator in the embodiment includes a thioxanthone based photopolymerization initiator (hereinafter, simply referred to as "thioxanthone"). In this manner, the curability of the ink is excellent and the degree of initial coloration of the curing film is particularly small.

Among the thioxanthones, since the sensitizing effect on acylphosphine oxide, the solubility with respect to the polymerizable compound, and the safety are excellent, 2,4-diethyl thioxanthone is preferable.

Examples of commercially available products of thioxanthone include KAYACURE DETX-S (2,4-diethyl thioxanthone) (manufactured by Nippon Kayaku Co., Ltd., product name), ITX (manufactured by BASF), and Quantacure CTX (manufactured by Aceto Chemical Industries).

The content of the thioxanthone is preferably in a range of 1 to 3 mass % with respect to the total amount (100 mass %) of the ink composition, and more preferably a range of 2 to 3 mass %. When the content is within the above-described range, the curability of the ink is excellent and the degree of initial coloration of the curing film is reduced.

In addition, examples of other photopolymerization initiators include Speedcure TPO (2,4,6-trimethylbenzoyl-diphenyl-phosphine oxide) and Speedcure DETX (2,4-diethylthioxanthen-9-one) (the above are product names manufactured by Lambson, Ltd.).

Coloring Material

The ink composition of the embodiment may further include a coloring material. It is possible to use a pigment as the coloring material.

Pigment

In the embodiment, it is possible to improve the light fastness of the ink composition by using a pigment as the coloring material. It is possible to use either an inorganic pigment or an organic pigment as the pigment.

As the inorganic pigments, it is possible to use types of carbon black (C.I. Pigment Black 7) such as furnace black, lamp black, acetylene black, channel black, iron oxide, and titanium oxide.

Examples of organic pigments include insoluble azo pigments, condensed azo pigments, azo lake, azo pigments such as chelate azo pigments, phthalocyanine pigments, perylene and perinone pigments, anthraquinone pigments, quinacridone pigments, dioxane pigments, thioindigo pigments, isoindolinone pigments, polycyclic pigments such as quinophthalone pigments, dye chelates (for example, basic dye type chelates, acidic dye type chelates, or the like), dye lakes (basic dye type lakes, acidic dye type lakes), nitro pigments, nitroso pigments, aniline black, and daylight fluorescent pigments.

More specifically, examples of the carbon black which is used as the black ink include No. 2300, No. 900, MCF88, No. 33, No. 40, No. 45, No. 52, MA7, MA8, MA100, No. 2200B (the above are product names manufactured by Mitsubishi Chemical Corporation), Raven 5750, Raven 5250, Raven 5000, Raven 3500, Raven 1255, Raven 700, or the like (the above are product names manufactured by Carbon Columbia), Regal 400R, Regal 330R, Regal 660R, Mogul L, Monarch 700, Monarch 800, Monarch 880, Monarch 900, Monarch 1000, Monarch 1100, Monarch 1300, Monarch 1400, and the like (product names manufactured by Cabot Japan K.K.), Color Black FW1, Color Black FW2, Color Black FW2V, Color Black FW18, Color Black FW200, Color Black 5150, Color Black 5160, Color Black 5170, Printex 35, Printex U, Printex V, Printex 140U, Special Black 6, Special Black 5, Special Black 4A, Special Black 4, and the like (the above are product names manufactured by Degussa).

Examples of the pigment used in the white ink include C.I. Pigment White 6, 18, and 21. In addition, it is also possible to use a metal atom-containing compound which is able to be used as a white pigment, examples of which include metal oxides which have been used in the past as white pigments, barium sulfate and calcium carbonate. The above-described metal oxides are not particularly limited; however, examples thereof include titanium dioxide, zinc oxide, silica, alumina, magnesium oxide, and the like.

Examples of the pigment which is used in the yellow ink include C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, and 180.

Examples of the pigment which is used in the magenta ink include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), 48 (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, and 245, or C.I. Pigment Violet 19, 23, 32, 33, 36, 38, 43, and 50.

Examples of the pigment which is used in the cyan ink include C.I. Pigment Blue 1, 2, 3, 15, 15:1, 15:2, 15:3, 15:34, 15:4, 16, 18, 22, 25, 60, 65, and 66, or C.I. Vat Blue 4 and 60.

In addition, examples of the pigments other than the magenta, cyan, and yellow include C.I. Pigment Green 7 and 10, C.I. Pigment Brown 3, 5, 25, and 26, and C.I. Pigment Orange 1, 2, 5, 7, 13, 14, 15, 16, 24, 34, 36, 38, 40, 43, and 63.

The above-described pigments may be used alone as one type or may be combined as two or more types.

In a case where the above-described pigments are used, the average particle diameter thereof is preferably 2 μm or less and more preferably 30 to 300 nm. When the average particle diameter is within the above-described range, the reliability of the ejection stability, dispersion stability, and the like of the ink composition are superior, and it is possible to form an image with excellent image quality. Here, the average particle diameter in the present specification is measured using a dynamic light scattering method.

Since the content of the coloring material has good color development properties and it is possible to reduce curing inhibition of the ink coating film using the light absorption of the coloring material itself, the content is preferably in a range of 1.5 to 6 mass % in the case of CMYK and preferably in a range of 15 to 30 mass % in the case of W with respect to total amount (100 mass %) of the ink composition.

Dispersant

In a case where the ink composition of the embodiment includes a pigment, in order to improve the pigment dispersibility, a dispersant may be further included. The dispersant is not particularly limited; however, examples thereof include dispersants customarily used to prepare pigment dispersions such as a polymer dispersant. Specific examples thereof include those in which the main component is one or more types from among polyoxyalkylene polyalkylene polyamine, vinyl based polymers and copolymers, acrylic based polymers and copolymers, polyester, polyamide, polyimide, polyurethane, amine based polymers, silicon-containing polymers, sulfur-containing polymers, fluorine-containing polymers, and epoxy resin.

Examples of commercially available polymer dispersants include the Aji Spa series (product name) manufactured by Ajinomoto Fine-Techno Co., Inc., the Solsperse series available from Lubrizol Corporation (Solsperse 36000, Solsperse 32000 and the like, product name), the Disperbyk series (product name) manufactured by BYK Chemie, and the Disparlon series (product name) manufactured by Kusumoto Chemicals.

Leveling Agent

The ink composition of the embodiment may further include a leveling agent (surfactant) in order to improve the wettability to the printing substrate. The leveling agent is not particularly limited; however, it is possible to use a polyester-modified silicone or polyether-modified silicone as a silicone-based surfactant, and the use of a polyether-modified polydimethylsiloxane or a polyester-modified polydimethylsiloxane is particularly preferable. Specific examples thereof include BYK-347, BYK-348, BYK-UV3500, 3510, 3530, and 3570 (product names manufactured by BYK Japan K.K.).

Polymerization Inhibitor

The ink composition of the embodiment may further include a polymerization inhibitor in order to improve the storage stability of the ink composition. The polymerization inhibitor is not particularly limited; however, it is possible to use IRGASTAB UV10 and UV22 (product name, manufactured by BASF), or hydroquinone monomethyl ether (MEHQ, product name, manufactured by Kanto Chemical Co., Inc.).

Other Additives

The ink composition of the present embodiment may include additives (components) other than the additives given above. Such components are not particularly limited; however, well-known polymerization accelerators, penetration enhancers, wetting agents (moisturizers), and other additives are possible. Examples of the above-described other additives include well-known fixing agents, fungicides, preservatives, antioxidants, ultraviolet light absorbing agents, chelating agents, pH adjusting agents, and thickeners.

Physical Properties of Ink Composition

The ink composition of the embodiment preferably has a viscosity of 15 mPa·s or less at 20° C., and more preferably 9 to 14 mPa·s. When the viscosity is within the above-described range, the solubility with the photopolymerization initiator and other additives is excellent, and ejection stability is able to be easily obtained. Here, the viscosity in the present specification is a value which is measured using a rheometer MCR300 manufactured by DKSH Japan K.K. In addition, it is preferable that the ink composition of the embodiment be curable by the irradiation of ultraviolet light of which the light emission peak wavelength is in the range of 350 to 450 nm.

Relationship Between Quality of Printed Image and Ink Properties

A relationship between various properties that UV ink has and the quality of a printed image obtained by using the UV ink will be described. The most suitable ink ejection order and integrated light quantity of UV to improve the quality of the printed image are determined in consideration of the properties of the UV ink.

Regarding Ink Ejection Order

In order to determine the ink ejection order, it is necessary to examine the "solidification" of ink. The solidification means the generation of "wrinkles" on the surface of the UN ink dot, and when the wrinkles are generated on the surface of the ink dot, the quality of the printed image is deteriorated. The solidification is generated by a pigment included in the UV ink absorbing ultraviolet (UV) light. When the UV ink dots which have landed on the medium are irradiated with UV, first, the surface of the ink dots is cured. At this time, since UV is absorbed by a pigment component on the surface portion of the ink dots, UV hardly reaches the inside of the ink dots. Therefore, only the surface of the ink dots is cured and the inside of the ink dots has fluidity. When the ink dots are further continuously irradiated with UV in this state, the inside of the ink is cured and contracted and wrinkles are generated on the surface of the ink dots, which has been already cured.

Particularly, in a case in which plural UV irradiation sections are provided in the transport direction as in the printer 1, solidification easily occurs. For example, while the first ink which has been ejected from the first head 31 in the printer 1 is being transported from the upstream side to the downstream side, the first ink is irradiated with UV by the first irradiation section 41 to the fourth irradiation section 44 plural times (at least four times in the printer 1). In this manner, an integrated light quantity of UV irradiation (integrated light quantity) to be irradiated onto the first ink is increased and the solidification easily occurs.

Regarding the above-described point, since the ink including a pigment that easily absorbs UV solidifies easily, when the ink ejection order is determined in the printer 1, it is necessary to consider differences among the pigments included in each color ink (KCMY). That is, the color ink which is easily solidified is set to be ejected from a head arranged on the downstream side in the transport direction as much as possible. In this manner, the number of UV irradiation on the ink during the transportation is reduced. Conversely, the color ink which is not easily solidified may be set to be ejected from a head arranged on the upstream side in the transport direction.

FIG. 5 is a table of compositions of each of the color inks of KCMY used when printing is performed in the embodiment. Among the above, Pigment Black 7 which is a black pigment included in black (K) and Pigment Yellow 155 which is a yellow pigment included in yellow (Y) easily absorb UV in a region of the peak wavelength (about 395 nm) of UV which is irradiated from the irradiation unit 40 during the pre-curing. Therefore, solidification easily occurs in black (K) and yellow (Y). Accordingly, black (K) and yellow (Y) are preferably ejected from the head arranged on the downstream side in the transport direction.

In contrast, since Pigment Blue 15:3 which is a cyan pigment included in cyan (C) and Pigment Red 122 which is a magenta pigment included in magenta (M) have lower UV absorbency than that of black (K) and yellow (Y) in a region of the peak wavelength (about 395 nm) of UV which is irradiated during the pre-curing, solidification does not easily occur. Accordingly, cyan (C) and magenta (M) are preferably ejected from the head arranged on the upstream side in the transport direction.

Regarding Integrated Light Quantity of UV

In order to determine an integrated light quantity of UV for pre-curing UV ink, it is necessary to examine the "bleeding" of ink. The bleeding means that different color inks are mixed on the medium by wetting and spreading of the ink dots which have landed on the medium to cause bleeding. In the printing using UV ink, the UV ink dots which have landed on the medium is irradiated with UV for pre-curing, and the ink dots are cured to a degree at which the ink dots are not completely cured (that is, a degree of not being mixed with other UV inks), and thus, the occurrence of bleeding is suppressed. Accordingly, it is possible to efficiently suppress the occurrence of bleeding by controlling the integrated light quantity of UV to be irradiated for each ink color. That is, as the ink is more easily curable, the integrated light quantity of UV may be set to be smaller, and as the ink is less easily curable, the integrated light quantity of UV may be set to be greater.

Figures 6A, 6B:
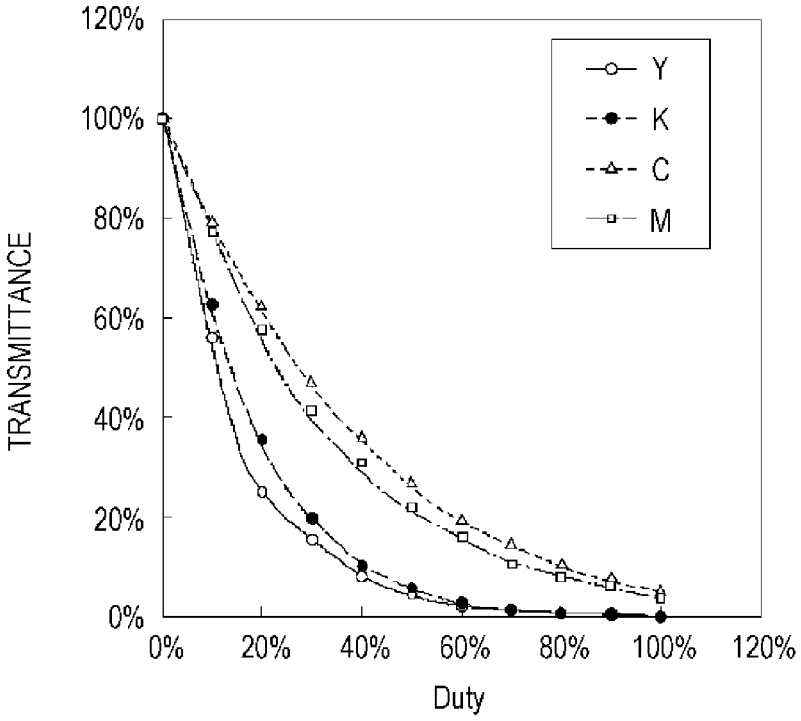
FIGS. 6A and 6B are diagrams illustrating light transmittance of four color inks of K, C, M, and Y.

Here, the curability of the ink is affected by transmittance showing ease of light transmission (difficulty in light transmission) to each of the color inks. FIGS. 6A and 6B are diagrams illustrating light transmittance of four color inks of K, C, M, and Y. A table in FIG. 6A is experimental data obtained by measuring transmittance of the four color UV inks of K, C, M, and Y used in printing. First, while duties (ejected amounts of inks per unit area) of the respective inks of K, C, M and Y are changed by 10% in a range of 0% to 100%, test patches (not illustrated) are printed. Then, when ultraviolet light with a predetermined intensity (for example, irradiation energy: 160 mJ/cm$^2$, and wavelength: 395 nm) is irradiated, ultraviolet transmittance for each duty is calculated based on the irradiation energy as much as the irradiation energy that is absorbed by the patches. FIG. 6B is a graph obtained by plotting the data of FIG. 6A. As clearly seen from FIG. 6B, regardless of the magnitude of the duty, it is found that yellow (Y) has the lowest transmittance. In the same manner, it is also found that black (K) has low transmittance. In contrast, magenta (M) and cyan (C) have higher transmittance compared to black (K) and yellow (Y). That is, it is found that in the four color inks of K, C, M and Y, the transmittance becomes higher in the order of Y<K<M<C.

From the results of FIGS. 6A and 6B, since it is found that magenta (M) and cyan (C) with high transmittance are inks that are easily solidified, it is possible to reduce the integrated light quantity of UV. Conversely, since it is found that yellow (Y) and black (K) with low transmittance are inks that are not easily solidified, it is necessary to increase the integrated light quantity of UV. Accordingly, the integrated light quantity of UV for pre-curing may be set such that the transmittance is high in the order of C<M<K<Y. Actually, in order to prevent the above-described solidification, the yellow ink (Y) is not irradiated with UV for pre-curing.

However, when the integrated light quantity of UV for pre-curing is determined only in consideration of curability, conversely, a printed image is deteriorated in some cases. For example, in a case of the cyan ink (C), when the integrated light quantity of UV is small, it is found that aggregation of the ink occurs and a printed image is deteriorated. In addition, in a case of the magenta ink (M), when the integrated light quantity of UV is small, it is found that solidification easily occurs (refer to FIG. 7 to be described later). Thus, as described later, the integrated light quantity of UV for pre-curing which is irradiated onto cyan (C) and magenta (M) is greater than the integrated light quantity of UV for pre-curing which is irradiated onto black (K). In addition, in a phenomenon such as solidification or aggregation, the degree of the solidification or aggregation cannot be improved (may be deteriorated) even when the integrated light quantity is increased by irradiating the inks with UV several times in a divided manner, and the state condition is determined by an integrated light quantity of UV which is initially irradiated onto the UV ink.

Determination of Ink Jet Ejection Order and Integrated Light Quantity of UV

FIG. 7 is an explanatory diagram illustrating a state in which bleeding and solidification occur in four color inks of K, C, M, and Y relative to an integrated light quantity of UV. In FIG. 7, in a case where UV irradiation is performed with a predetermined integrated light quantity (irradiation energy), when the occurrence frequency of solidification or the like for each of the color inks (K, C, M, and Y) is high, it is expressed as "X", and when the occurrence frequency of solidification is low, it is expressed as "○". When it is neither of the above cases, it is expressed as "Δ".

First, as to yellow (Y), it is found that solidification occurs in the almost all regions of the integrated light quantity (irradiation energy) of UV for pre-curing. This is because the pigment included in the yellow ink easily absorbs UV as described above. Here, yellow (Y) is not irradiated with UV for pre-curing and is suddenly irradiated with UV for main curing to cure the ink. In this manner, it is possible to suppress the occurrence of solidification. Thus, yellow (Y) is set as the fourth ink so as to be ejected from the fourth head 34 which is a head on the most downstream side in the transport direction in the printer 1. Here, in the embodiment, in order to not pre-cure yellow (Y), an irradiation section for pre-curing is not provided on the downstream side of the fourth head 34 in the transport direction (refer to FIG. 2).

Next, as to black (K), in order to prevent the solidification as describe above, it is preferable that the ink be ejected from a head which is arranged on the downstream side in the transport direction as much as possible. In the embodiment, since yellow is preferentially set as the fourth ink, black (K) is set as the third ink so as to be ejected from the third head 33 which is provided in the second place from the downstream side in the transport direction in the printer 1.

In addition, from the data of FIG. 7, UV for pre-curing irradiated from the third irradiation section 43 may be set in a range in which irradiation energy is 5 to 10 mJ/cm$^2$. When the integrated light quantity of UV is within the range, bleeding, solidification, and aggregation do not easily occur, and thus, it is possible to print a satisfactory image.

Subsequently, cyan (C) or magenta (M) is set as the first ink or the second ink. As described above, even when cyan (C) and magenta (M) are ejected together from the heads (the first head 31 and the second head 32) on the upstream side in the transport direction, solidification does not easily occur and the quality of a printed image is not easily deteriorated.

Further, from the data of FIG. 7, UV for pre-curing irradiated from the first irradiation section 41 and the second irradiation section 42 may be set in a range in which irradiation energy is 12 to 30 mJ/cm$^2$. When the integrated light quantity of UV is lower than the above range, solidification and aggregation easily occur. That is, the integrated light quantity of UV irradiated from the first irradiation section 41 and the second irradiation section 42 is set to be greater than the integrated light quantity of UV irradiated from the third irradiation section 43. When the integrated light quantity of UV is within the above range, bleeding, solidification, and aggregation do not easily occur, and thus, it is possible to print a satisfactory image.

Here, it may be determined which of cyan (C) and magenta (M) is set as the first ink or the second ink by comparing gamuts. The gamut means a color region and refers a color region that can be expressed by the printing apparatus. As the gamut becomes wider, the color of the original data (image) is more likely to be accurately reproduced. When printing is performed by a line printer such as the printer 1 using four color inks of K, C, M, and Y, the color reproducibility of the original data is changed by what color ink is ejected in which order. Here, the ink ejection order is determined such that a gamut value is increased as much as possible.

FIG. 8 is data in which the gamuts are compared when the ink ejection orders of cyan (C) and magenta (M) are changed. In the drawing, the width of the gamut is expressed by a coverage in a color chart of "Pantone" (trade name).

It is found that the coverage is high in a case in which the ink ejection order is set as an order of C, M, K and Y from the upstream side in the transport direction, compared to a case in which the ink ejection order is set as an order of M, C, K and Y from the upstream side in the transport direction. That is, the gamut is wide in a case in which the first ink is set as cyan (C) and the second ink is set as magenta (M), compared to a case in which the first ink is set as magenta (M) and the second ink is set as cyan (C), and thus, it is possible to print an image with high quality.

Modification Example of Printing Apparatus

In the above-described embodiment, the printing apparatus (FIG. 2) in which the medium is transported on a straight line is described, but the configuration of the printing apparatus is not limited thereto. For example, the printing apparatus may be a printing apparatus which ejects ink while transporting the medium on a peripheral surface of the transport drum by rotating a transport drum.

Figure 9:
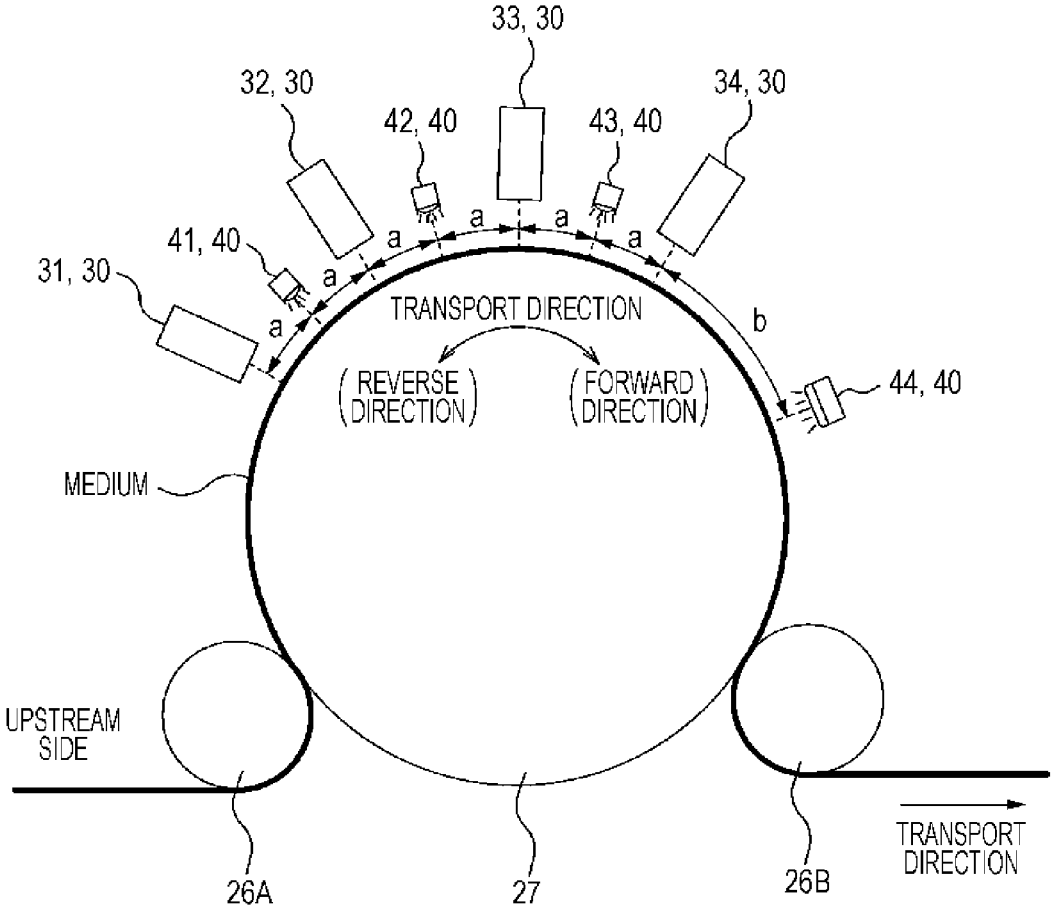
FIG. 9 is a schematic side view illustrating the configuration of a printer according to a modification example.

FIG. 9 is a schematic side view of the configuration of a printer 2 according to a modification example. The overall configuration and the function of each unit are almost the same as in the first embodiment (refer to FIG. 1), but the configurations of the transport unit 20, the head unit 30, and the irradiation unit 40 are different.

The transport unit 20 in the modification example has an upstream side transport roller 26A, a downstream side transport roller 26B, and a transport drum 27 which transports a long recording medium that is wound in a roll shape by a peripheral surface. When a transport motor (not illustrated) rotates, the upstream side transport roller 26A and the downstream side transport roller 26B are rotated, and the transport drum 27 is rotated. The medium which is pressed and supported by the upstream side transport roller 26A and the downstream side transport roller 26B along the peripheral surface of the transport drum 27 is transported in a clockwise direction (forward direction) in FIG. 9 according to the rotation of the transport drum 27. That is, in the modification example, the transport direction of the medium is a rotation direction of the transport drum 27 (a peripheral surface direction of the drum). Here, the transport speed of the medium by the transport unit 20 (the rotation speed of the transport drum 27) is controlled by the controller 60 such that the transport speed is a predetermined speed (almost constant speed). In addition, it is possible to transport the medium in a reverse direction by rotating the transport drum 27 in a counterclockwise direction.

Outside of the transport drum 27, the head unit 30 and the irradiation unit 40 are provided between the upstream side transport roller 26A and the downstream side transport roller 26B so as to face the peripheral surface of the transport drum. While the medium that is transported by the rotation of the transport drum 27 is printed in a printable region (a region facing the head unit 30), the medium is transported to the downstream side in the transport direction. That is, since the transport drum 27 transports the medium, the medium is moved in the transport direction with respect to the head unit 30. Here, the medium is supported by the transport drum 27 due to the friction force of the surface of the transport drum 27 during the transportation. That is, the transport drum 27 is a supporting member which supports the medium in a curved-surface shape.

In the printer 2, the first head 31, the first irradiation section 41, the second head 32, the second irradiation section 42, the third head 33, the third irradiation section 43, the fourth head 34, and the fourth irradiation section 44 are arranged along the curved surface (the peripheral surface) of the transport drum 27 in order from the upstream side in the transport direction (FIG. 9).

The distance relationship between each of the heads and the respective irradiation sections is the same as in the case of FIG. 2. Here, the distance between each of the heads and the respective irradiation sections is a distance along the curved surface (peripheral surface) of the drum between a position in which the ink dots which have been ejected from the head land on the transport drum 27 (the medium supported by the transport drum 27) which is a medium supporting member and an intersectional position of the flux center of ultraviolet light irradiated from the irradiation section and the supporting member (refer to FIG. 9).

Other Embodiments

Although the printer or the like is described as the embodiments, the above-described embodiments are to facilitate understanding of the invention but are not to be construed as limiting the invention. It is possible to modify and improve the invention without departing from the spirit thereof and it is needless to say that the invention also includes equivalents thereof.

Regarding Piezo Element

In each of the above-described embodiments, the piezo element PZT is used as an element which performs an operation for ejecting a liquid, but another element may be used. For example, a heating element or an electrostatic actuator may be used.

Regarding Printer Driver

In each of the above-described embodiments, the processes of the printer driver are performed by the computer (PC) 110, but may be performed by the printer itself by installing the printer driver in the controller 60.

What is claimed is:

1. A printing apparatus comprising:

a supporting member which supports a medium;

a transport device which transports the medium supported by the supporting member in a transport direction;

a first head which ejects a first radiation curable type ink;

a second head which is arranged on a downstream side of the first head in the transport direction and ejects a second radiation curable type ink;

a third head which is arranged on the downstream side of the second head in the transport direction and ejects a third radiation curable type ink, wherein the third ink is black;

a fourth head which is arranged on the downstream side of the third head in the transport direction and ejects a fourth radiation curable type ink, wherein the fourth ink is yellow;

a first irradiation section which is arranged between the first head and the second head in the transport direction and irradiates radiation rays with an integrated light quantity to a degree at which the first ink ejected from the first head is not completely cured;

a second irradiation section which is arranged between the second head and the third head in the transport direction and irradiates radiation rays with an integrated light quantity to a degree at which the second ink ejected from the second head is not completely cured;

a third irradiation section which is arranged between the third head and the fourth head in the transport direction and irradiates radiation rays with an integrated light quantity to a degree at which the third ink ejected from the third head is not completely cured; and a fourth irradiation section which is arranged on the downstream side of the fourth head in the transport direction and irradiates radiation rays with an integrated light quantity to a degree at which wetting and spreading of the first to fourth inks respectively ejected from the first to fourth heads are stopped on the medium, wherein the radiation rays respectively irradiated from the first irradiation section to the third irradiation section have a peak wavelength of 350 nm to 450 nm, and coloring materials included in the third ink and the fourth ink have higher absorption properties of the radiation rays with the peak wavelength than coloring materials included in the first ink and the second ink, a controller configured to adjust a size of the input current of the first irradiation section, the second irradiation section and the third irradiation section so that the integrated light quantity of the radiation rays irradiated from the first irradiation section and the second irradiation section are greater than the integrated light quantity of the radiation rays irradiated from the third irradiation section.

2. The printing apparatus according to claim 1, wherein when the first ink is magenta, the second ink is cyan, or when the first ink is cyan, the second ink is magenta.

3. The printing apparatus according to claim 2, wherein an image printed when the first ink is set to cyan and the second ink is set to magenta has a wider gamut than an image printed when the first ink is set to magenta and the second ink is set to cyan.

4. The printing apparatus according to claim 1, wherein a distance between the first head and the first irradiation section in the transport direction is equal to a distance between the first irradiation section and the second head in the transport direction, a distance between the second head and the second irradiation section in the transport direction is equal to a distance between the second irradiation section and the third head in the transport direction, and a distance between the third head and the third irradiation section in the transport direction is equal to a distance between the third irradiation section and the fourth head in the transport direction.

5. The printing apparatus according to claim 1, wherein the first ink is cyan and the second ink is magenta.

6. The printing apparatus according to claim 1, wherein a distance between the fourth head and the fourth irradiation section is greater than a distance between another of the heads and an irradiation section that is immediately downstream of the another head.

7. The printing apparatus according to claim 1, wherein all of the following distances are the same: a distance between the first head and the first irradiation section; a distance between the second head and the second irradiation section; a distance between the third head and a third irradiation section; and a distance between the third irradiation section and the fourth head.

8. The printing apparatus according to claim 1, wherein the first head, the first irradiation source, the second head, the second irradiation source, the third head, the third irradiation source, the fourth head, and the fourth irradiation source are positioned in a curved arrangement along a portion of a transport path.

* * * * *